United States Patent [19]

Lehfeldt

[11] 3,988,786

[45] Nov. 2, 1976

[54] AUXILIARY FLUSH VALVE MECHANISM FOR TOILET TANKS

[76] Inventor: Erick Lehfeldt, 54 Anchor Drive, Pittsburg, Calif. 94565

[22] Filed: June 17, 1975

[21] Appl. No.: 587,416

[52] U.S. Cl. ..... 4/67 A

[51] Int. Cl.[2] ..... E03D 1/14

[58] Field of Search ..... 4/34, 37, 67 R, 67 A, 4/249; 74/479, 480, 483 R

[56] References Cited

UNITED STATES PATENTS

| | | | |
|---|---|---|---|
| 2,532,977 | 12/1950 | White | 4/67 A |
| 2,741,776 | 4/1956 | Christie | 4/67 A X |
| 2,744,261 | 5/1956 | Gram | 4/67 A |
| 2,809,378 | 10/1957 | Newton | 4/67 A |
| 3,141,177 | 7/1964 | Kerfell | 4/67 A X |
| 3,906,554 | 9/1975 | Johnson | 4/34 |

*Primary Examiner*—Harry N. Haroian
*Assistant Examiner*—Stuart S. Levy
*Attorney, Agent, or Firm*—John Walker

[57] ABSTRACT

An auxiliary mechanism whereby the water release from a toilet tank can be controlled and limited at each operation. A second handle is provided, the use of which permits only a restricted amount of lift of the flush valve.

1 Claim, 4 Drawing Figures

Fig. 1
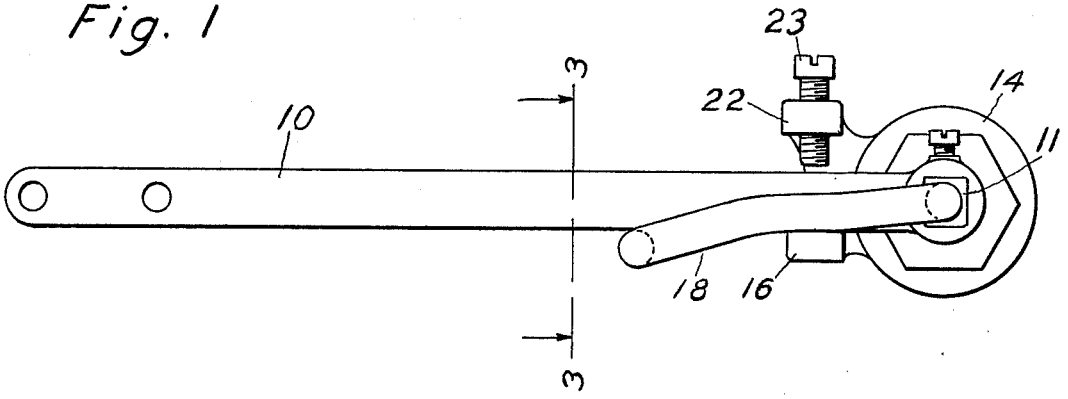
Fig. 2
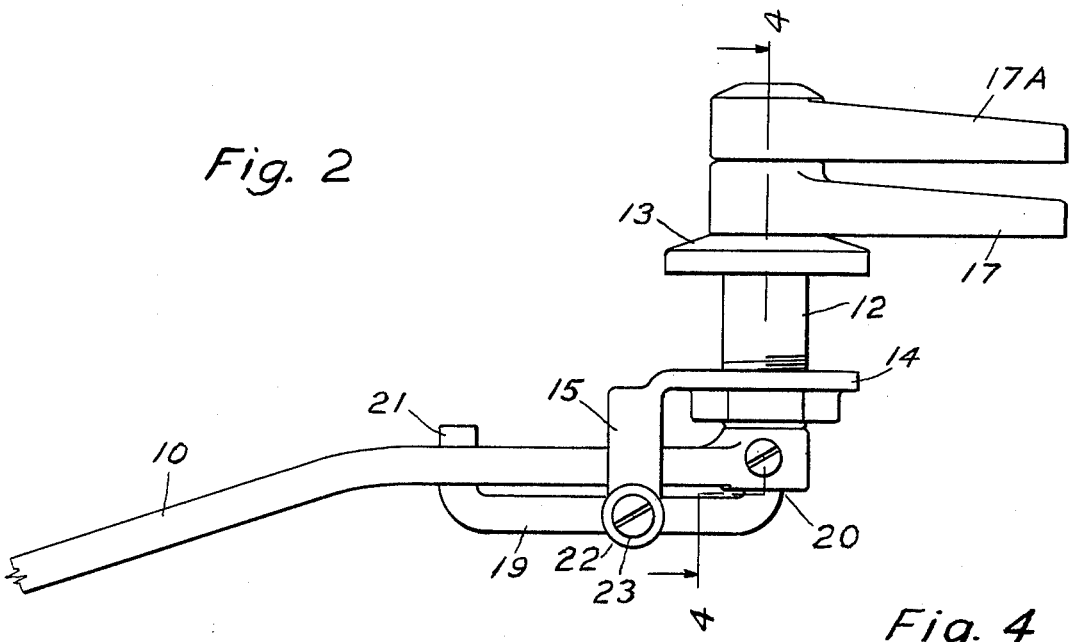
Fig. 4
Fig. 3
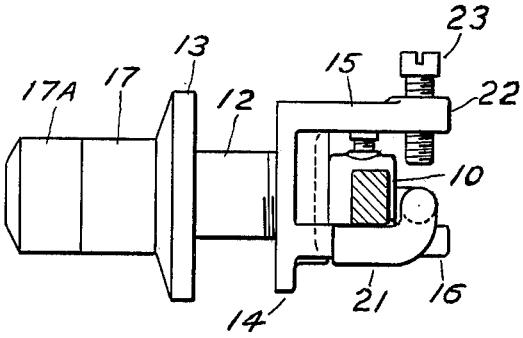
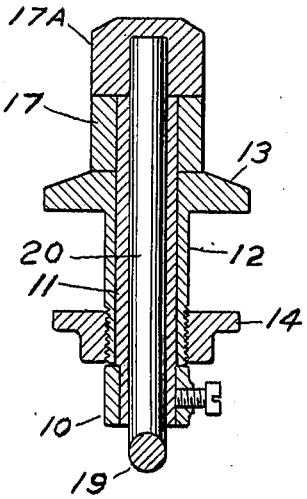

AUXILIARY FLUSH VALVE MECHANISM FOR TOILET TANKS

BACKGROUND OF THE INVENTION

The conventional type of mechanism for actuating the flush valve in a toilet tank has been in use for decades, and generally speaking, it has provided relatively trouble-free and efficient service. It does have one feature, however, to which attention is now being turned, and that is the fact, that at each flushing operation, the entire contents of the tank is discharged.

While in the past, it has never been considered a matter of any concern, present conditions have altered such an attitude, and various suggestions have been made to alleviate water demands in this particular area. One such suggestion is "put a brick in your tank." The efficacy of this method is open to question. Toilet tanks are usually designed to discharge an adequate amount of water to take care of normal conditions, and any reduction of that amount frequently makes a second flushing necessary.

Bending of the rod which carries the ball float is sometimes resorted to. This method has two further disadvantages. The ball float on a bent rod has a tendency to rotate the rod, causing interference with the float and the side of the tank, and thereby preventing the supply of water to the tank from being shut off. Another reason why this method is ill-advised is because lowering of the level of water in the tank decreases the head of the discharge with consequent lack of efficiency of operation.

The present invention is based upon the fact, that there times when the complete discharge of a toilet tank is unnecessary. If there is no solid matter to be disposed of, any other need for flushing can usually be satisfied by a much smaller discharge of water. It is the principal object of the invention, therefore, to provide a means whereby a curtailed flushing of a tank can be effected. A further object is to provide adjustment for such means.

These and other objects of the invention will become apparent during the course of the following description, taken in connection with the accompanying drawing forming a part hereof:

BRIEF DESCRIPTION OF THE DRAWING

FIG. 1 is an elevation as viewed from the inside of a toilet tank, showing a typical flush valve operating mechanism, to which an auxiliary mechanism has been added.

FIG. 2 is a plan view of the mechanism shown on FIG. 1.

FIG. 3 is a section taken on line 3 — 3 of FIG. 1.

FIG. 4 is a section taken on line 4 — 4 of FIG. 2.

DESCRIPTION OF THE PREFERRED EMBODIMENT

Referring to the drawing in detail, a typical flush valve operating mechanism is illustrated, two of the components having slight modifications to conventional design, A lever 10, fixedly mounted on a spindle 11, is pivotal therewith. This spindle is journalled by being coaxially mounted in a sleeve 12, which passes through the wall of the tank, and is secured in place by a collar or flange 12 on the outside of the tank, and a nut 14 on the inside. This nut is of special design, with upper and lower stops 15 and 16 respectively also being provided to limit the angular movement of the lever 10. With an operating handle 17, this completes the description of the design and arrangement of a conventional operating mechanism.

Directing attention to FIG. 4, it will be seen that the spindle 11 is of tubular form, and has pivotally mounted therein, a crank 18, which, at its point of exit from the spindle, is bent at ninety degrees, and, as shown on FIG. 2, closely adjacent to and parallel with the lever 10. Separately described in its basic form, the crank 18 consists of a rod bent into a U shape, the corners being sharply bent. It has a lever portion 19, a long leg forming a spindle 20 and a relatively short leg 21 which passes under the lever 10 and is in contact therewith. The lever portion 19, as illustrated in FIG. 1, is so formed as to allow the portion 21 to assume a position of rest on the lower stop 16 while allowing the shorter leg to pass under the lever 10 as previously mentioned. The spindle 20 extends outwardly, beyond the end of the hollow spindle 11, a sufficient distance to allow a second operating handle 17A to be fixedly mounted thereon. It should be understood that the crank 18 can be fabricated using separate parts connected in any suitable manner, the final choice, of course, being decided by economic considerations and presently known manufacturing technology.

As shown on FIG. 3, the upper stop 15 has been provided with a boss 22 having a threaded aperture for the reception of an adjusting screw 23. As can be seen by reference to FIGS. 1 and 3, this screw is so positioned as to be able to limit the upward motion of the crank 18.

The auxiliary mechanism, as described and illustrated, in no way interferes with or affects operation of the basic installation. During such operation, at the initial manipulation of the handle, a slight resistance is felt which is caused by the head of the water in the tank and its sudden release. At the point of buoyancy of the valve, this reaction is no longer evident, and the valve rises to the surface of the water, being no longer under control of the handle. When the auxiliary mechanism is used, however, the restricted angular movement of its lever maintains the valve at a level below the point of buoyancy. It is therefore possible to discharge any desired amount of water by merely holding the operating handle of said mechanism in the flushing position, or at a point short thereof. The period of time during which flow takes place is also under control by the mere act of holding the handle in one position for such period.

From the foregoing it will be apparent that I have provided a reliable means of definitely curtailing the consumption of water in continued flushing operations, and while I have described and illustrated a preferred embodiment of my invention, it should be understood that modifications may be made within the spirit and intent of Title 35, United States Code Section 112, Par. 3.

I claim:

1. A toilet tank flush valve operating mechanism for lifting the valve by a lever adapted for angular movement, a rotatable spindle having said lever fixedly mounted on the inner end thereof, an operating handle fixedly mounted on said spindle at the outer end thereof, upper and lower stops adapted to establish a range of angular movement, said lever being controlled relative to its range of angular movement, and wherein the improvement consists of a second lever adapted to coact with said first lever, said second lever consisting of a rod bent into a U shape, the corners being substantially sharply bent, and comprising a relatively long leg, forming a second spindle rotatably and axially mounted within said first spindle, and extending a relatively short distance beyond the outer end thereof, and a shorter leg passing under said first mentioned lever and being in close proximity to the under side thereof, and a second operating handle fixedly mounted on the outer projecting end of said second spindle, a boss at the remote end of said upper stop having a threaded aperture, an adjusting screw engaging the aperture of said boss, and being so positioned as to permit the range of travel of said second lever to be preset, thereby permitting control and restriction of said valve up to a point below the level of buoyancy thereof whereby the amount of discharge of water from a tank can be regulated.

* * * * *